US008376772B2

(12) United States Patent
Lizanets

(10) Patent No.: US 8,376,772 B2
(45) Date of Patent: Feb. 19, 2013

(54) ELECTRICAL PLUG CONNECTOR

(75) Inventor: Vasyl Lizanets, Lviv (UA)

(73) Assignee: Tyco Electronics Ukraine Ltd, Ivan-Frankivosk (UA)

( * ) Notice: Subject to any disclaimer, the term of this patent is extended or adjusted under 35 U.S.C. 154(b) by 0 days.

(21) Appl. No.: 13/319,945

(22) PCT Filed: Apr. 29, 2010

(86) PCT No.: PCT/EP2010/055809

§ 371 (c)(1), (2), (4) Date: Nov. 10, 2011

(87) PCT Pub. No.: WO2010/130584

PCT Pub. Date: Nov. 18, 2010

(65) Prior Publication Data

US 2012/0058664 A1 Mar. 8, 2012

(30) Foreign Application Priority Data

May 14, 2009 (DE) ..... 10 2009 003 103

(51) Int. Cl.
*H01R 13/62* (2006.01)

(52) U.S. Cl. ..... 439/372

(58) Field of Classification Search ..... 439/372, 439/159, 160

See application file for complete search history.

(56) References Cited

U.S. PATENT DOCUMENTS

| | | | | |
|---|---|---|---|---|
| 5,022,866 | A * | 6/1991 | Harting et al. | 439/372 |
| 5,658,162 | A | 8/1997 | Harting et al. | |
| 7,717,723 | B2 * | 5/2010 | Nehm | 439/157 |
| 2003/0109166 | A1 * | 6/2003 | Ookura | 439/372 |
| 2009/0311905 | A1 * | 12/2009 | Ferderer et al. | 439/372 |

FOREIGN PATENT DOCUMENTS

| | | | |
|---|---|---|---|
| DE | 3937022 | C1 | 9/1990 |
| DE | 19508605 | C1 | 7/1996 |
| DE | 19828414 | A1 | 12/1999 |
| DE | 202004004619 | U1 | 5/2004 |
| DE | 202005005241 | U1 | 12/2005 |
| DE | 102004061046 | A1 | 7/2006 |
| EP | 1622232 | A1 | 2/2006 |

OTHER PUBLICATIONS

International Preliminary Report on Patentability issued by the International Bureau of WIPO, Geneva, Switzerland, dated Nov. 15, 2011 for International Application No. PCT/EP2010/055809; 7 pages.

International Search Report and Written Opinion issued by the European Patent Office, Rijswijk, Netherlands, dated Sep. 9, 2010, for International Application No. PCT/EP2010/055809; 14 pages.

Search Report issued by the German Patent and Trademark Office, dated Mar. 29, 2010, for Priority Application No. DE102009003103.0; 3 pages.

* cited by examiner

*Primary Examiner* — Gary F. Paumen

(74) *Attorney, Agent, or Firm* — Faegre Baker Daniels LLP

(57) ABSTRACT

An electrical plug connector comprises a first housing part and a second housing part. The second housing part has a first journal. The first housing part has a first locking hook. A first end of the first locking hook is rotatably connected to the first housing part. A second end of the first locking hook has a rotatably arranged first locking element. In this case, the first locking element can be passed on a path partially around the first journal by pivoting the first locking hook. The first locking element has a contour having at least two concave outer edges arranged at an angle to one another.

14 Claims, 5 Drawing Sheets

ELECTRICAL PLUG CONNECTOR

The invention relates to an electrical plug connector according to claim 1.

Electrical plug connectors are known in many different designs. It is also known to design electrical plug connectors in a modular fashion. Electrical plug connectors of this type can for example consist of one or more housing parts into which a number of different inserts can be integrated. In plug connectors having a plurality of housing parts, different systems are known for connecting the housing parts.

The object of the invention is to provide an improved electrical plug connector. This object is achieved by an electrical plug connector having the features of claim 1. Preferred embodiments of the plug connector are specified in the dependent claims.

According to the invention, an electrical plug connector comprises a first and a second housing part. In this case, the second housing part has a first journal and the first housing part has a first locking hook. A first end of the first locking hook is rotatably connected to the first housing part. A second end of the first locking hook has a rotatably arranged first locking element. In this case, the first locking element can be passed on a path partially around the first journal by pivoting the first locking hook. In addition, the first locking element has a contour with at least two concave outer edges arranged at an angle to one another.

Advantageously, this electrical plug connector has a housing which may be opened and closed in a simple manner. Excess wear to the first journal of the second housing part is in this case prevented by the at least two concave outer edges of the locking element. This advantageously enables the electrical plug connector to be closed and reopened a large number of times.

Preferably, the first locking element is arranged symmetrically with respect to rotation through a defined angle. Advantageously, the electrical plug connector can then be closed independently of the position of the first locking element, thus simplifying handling of the electrical plug connector.

Particularly preferably, the first locking element has a triangular contour with rounded-off corners and concave outer edges. Advantageously, the triangular contour allows a large radius of curvature of the concave outer edges while the locking element as a whole remains small. As a result, this shaping of the locking element allows simple and secure closure of the electrical plug connector and prevents excessive wear to the first journal of the electrical plug connector.

Expediently, the concave outer edge of the first locking element has a recess. This has the advantage of preventing or impeding accidental opening of the electrical plug connector.

According to one embodiment, each concave outer edge of the first locking element has a symmetrically arranged recess taking up roughly one third of the length of the outer edge. Advantageously, this embodiment allows in accordance with the invention simple and secure locking of the electrical plug connector.

According to another embodiment, each concave outer edge of the first locking element has an asymmetrically arranged recess taking up roughly half the length of the outer edge. Advantageously, this embodiment has also proven suitable to lock the electrical plug connector simply and securely.

In a development of the electrical plug connector, the first locking element has a central borehole, the first locking element being connected to the second end of the first locking hook via a bolt running through the central borehole. Advantageously, this allows a simple and inexpensive design of the electrical plug connector.

Expediently, a surface of the first locking element has a notch extending from the central borehole to one of the corners of the locking element. This has the advantage that the notch simplifies the mounting of the first locking element.

Preferably, each of the concave outer edges of the first locking element has roughly the contour of an arc of a circles having a radius r and an angle of 60°, the radius r having a size of between 5 mm and 25 mm, preferably between 10 mm and 20 mm. Advantageously, a configuration of this type of the concave outer edges of the first locking element allows particularly simple closure of the electrical plug connector, wear to the first journal being prevented at the same time.

Expediently, the first locking element has a thickness of between 1 mm and 3 mm. This advantageously ensures sufficient stability of the first locking element.

Expediently, the first locking element is made of steel. This has the advantage of ensuring sufficient stability of the first locking element.

Expediently, the surface of the first locking element is zinc-plated or chromium-plated. Advantageously, this prevents corrosion of the first locking element.

In one development, the electrical plug connector has a second locking hook with a second locking element, the first locking hook and the second locking hook being arranged on opposing outer faces of the first housing part and being pivotable about a common first axis of rotation. In this case, the second housing part has a second journal and the second locking element can be passed on a path partially around the second journal by pivoting the second locking hook. Furthermore, the first and the second locking hook are connected to each other via a clip and form a first locking device. This has the advantage that the first locking device joins together the first housing part and the second housing part on two opposing outer faces of the housing of the electrical plug connector. In addition, the first and the second locking hook of the first locking device can be opened and closed at the same time.

In an additional development of the electrical plug connector, said plug connector has a second locking device which is pivotable about a second axis of rotation, the first axis of rotation and the second axis of rotation being oriented parallel to each other. Advantageously, the electrical plug connector can then be closed at a total of four points.

The invention will be described hereinafter in greater detail with reference to the figures. The same reference numerals will be used throughout for like or equivalent parts. In the drawings.

Figure 1:
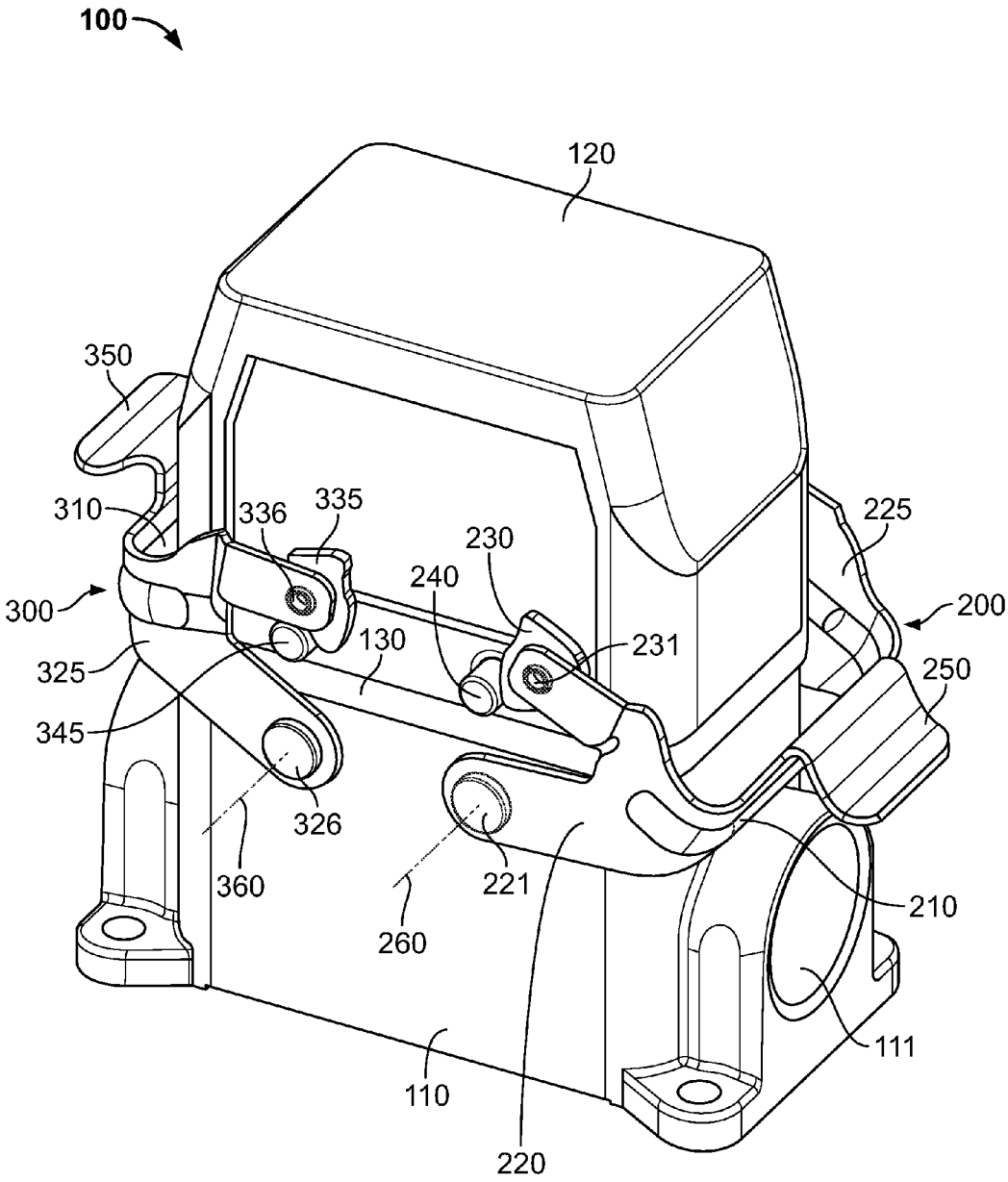
FIG. 1 is a perspective oblique view of an electrical plug connector.

FIG. 1 is a perspective oblique view of an electrical plug connector 100. The electrical plug connector 100 comprises a first housing part 110 and a second housing part 120. The first housing part 110 and the second housing part 120 are connected to each other in a manner described in greater detail below. In this case, a sealing element 130, which ensures a seal of the electrical plug connector 100, is arranged between the first housing part 110 and the second housing part 120.

The sealing element 130 can electromagnetically seal the electrical plug connector 100. Alternatively or additionally, the sealing element 130 can seal the electrical plug connector 100 so as to prevent the infiltration of dust and/or moisture.

Figure 2:
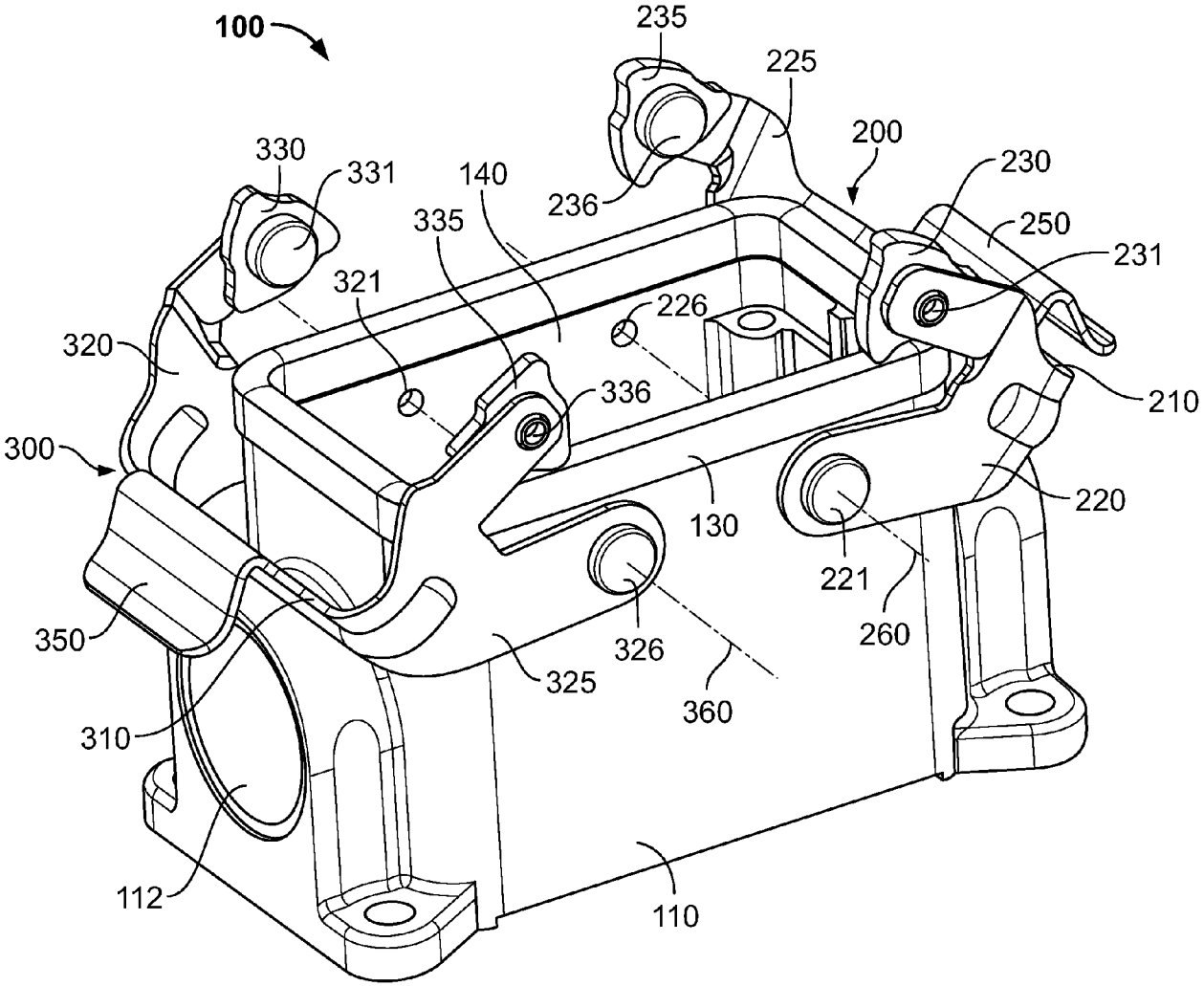
FIG. 2 is a perspective view of a first housing part of the electrical plug connector.
Figure 3:
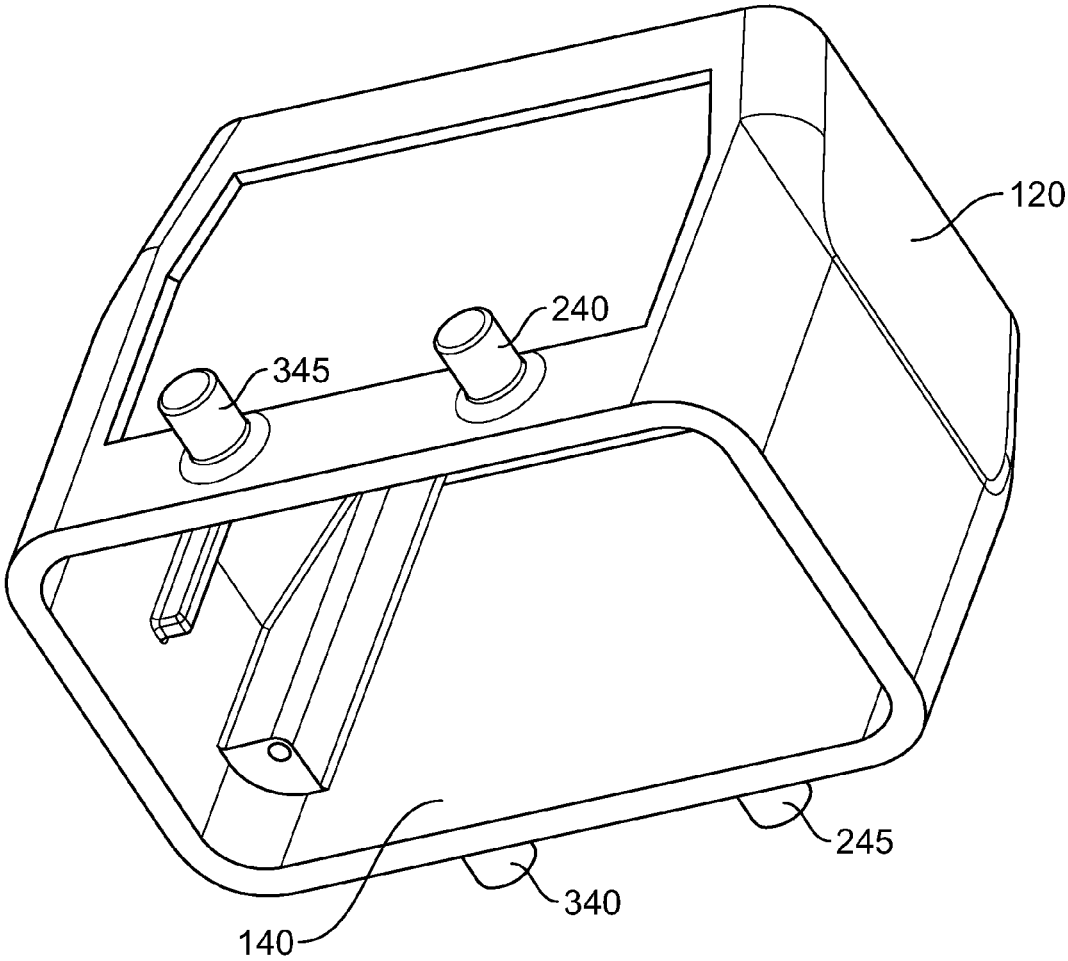
FIG. 3 is a perspective view of a second housing part of the electrical plug connector.

FIG. 2 is a perspective oblique view of the electrical plug connector 100, the second housing part 120 of the electrical plug connector 100 having been removed in the illustration of FIG. 2. FIG. 3 is a perspective oblique view of the second housing part 120.

FIGS. 2 and 3 show that the first housing part 110, and the second housing part 120 of the electrical plug connector 100 enclose when joined together, an interior space 140. FIGS. 1 and 2 show that the first housing part 110 has a first cable aperture 111 and a second cable aperture 112 extending from two mutually opposing outer faces of the first housing part 110 toward the interior space 140 of the electrical plug connector 100. The interior space 140 of the electrical plug connector 100 can be accessed through the first cable aperture 111 and the second cable aperture 112. Two cables can be passed from the exterior into the interior space 140 of the electrical plug connector 100 through the first cable aperture 111 and the second cable aperture 112. In alternative embodiments of the electrical plug connector 100, the first cable aperture 111 and/or the second cable aperture 112 may be dispensed with. In these embodiments, just one cable is inserted into the interior space 140 of the electrical plug connector 100. The first cable aperture 111 and/or the second cable aperture 112 can also be provided on other surfaces of the first housing part 110 or on a surface of the second housing part 120.

Any desired electrical and/or mechanical components can be arranged in the interior space 140. The components arranged in the interior space 140 can for example be electrically connected to one or more wires of the cables passed through the first cable aperture 111 and the second cable aperture 112. For this purpose, the components arranged in the interior space 140 can have for example insulation displacement terminals, soldering points, contact pins or other connecting elements. The components arranged in the interior space 140 can also have active or passive electrical elements.

FIGS. 1 and 2 show that the electrical plug connector 100 has a first locking device 200, provided to connect or to lock the first housing part 110 to the second housing part 120. The first locking device 200 comprises a first locking hook 220 arranged in a roughly V-shaped manner. A first end of the V-shaped first locking hook 220 is connected to the first housing part 110 by means of a first pin 221 in such a way that the first locking hook 220 is pivotable about a first axis of rotation 260. The first axis of rotation 260 lies in this case perpendicularly on a surface of the first housing part 110. The first pin 221 can be arranged as a rivet, for example, which is passed through boreholes in the first locking hook 220 and in the first housing part 110.

The second housing part 120 has a first journal 240 positioned perpendicularly on a surface of the second housing part 120. The first journal 240 is arranged roughly cylindrically and can be made of aluminium, for example.

A second end of the first locking hook 220 has a rotatably arranged first locking element 230. The first locking element 230 is connected to the first locking hook 220 by means of a first bolt 231. The first bolt 231 can be designed as a rivet which is passed through boreholes in the first locking element 230 and in the first locking hook 220.

The first locking hook 220 is pivotable about the first axis of rotation 260 in such a way that the first locking element 230 is passed on a circular or non-circular path around the first journal 240. The first journal 240 can in this case therefore penetrate a space between the two arms, which are arranged in a V-shaped manner, of the first locking hook 220. If the first locking hook 220 is pivoted in this way, then the first journal 240 intersects a notional connecting line between the first pin 221 and the first bolt 231 of the first locking hook 220.

In the exemplary embodiment of FIGS. 1 to 3, the first locking device 200 further comprises a second locking hook 225 arranged mirror-symmetrically to the first locking hook 220. The second locking hook 225 is thus also arranged in a V-shaped manner, a first end of the V-shaped second locking hook 225 being pivotably connected to the first housing part 110 by means of a second pin 226. The second locking hook 225 is in this case arranged on a surface of the first housing part 110 that opposes the surface of the first housing part 110 on which the first locking hook 220 is arranged. The second locking hook 225 is also pivotable about the first axis of rotation 260.

FIG. 2 shows that a second end of the V-shaped second locking hook 225 has a second locking element 235 which is rotatably connected to the second locking hook 225 by means of a second bolt 236.

FIG. 3 shows that the second housing part 120 has a second journal 245 which is arranged perpendicularly on a surface of the second housing part 120 that opposes the surface of the second housing part 120 on which the first journal 240 is arranged. The second locking element 235 can be passed on a circular or non-circular path around the second journal 245 by pivoting the second locking hook 225 about the first axis of rotation 260. The second journal 245 intersects in this case a notional connecting line between the second pin 226 and the second bolt 236.

The first locking hook 220 and the second locking hook 225 of the first locking device 200 are connected to a first clip 210. The first clip 210 is attached to a pointed end of the V-shaped first locking hook 220 and to a pointed end of the V-shaped second locking hook 225. Together, the first locking hook 220, the first clip 210 and the second locking hook 225 form the roughly U-shaped first locking device 200. The first clip 210 enables the first locking hook 220 and the second locking hook 225 to be pivoted only jointly about the first axis of rotation 260. If the first locking device 200 is pivoted about the first axis of rotation 260, then the first locking element 230 is passed around the first journal 240 and the second locking element 235 is at the same time passed around the second journal 245. The first clip 210 has a first operating lip 250 which is attached roughly perpendicularly to the first clip 210 and facilitates pivoting of the first locking device 200.

The electrical plug connector 100 also has a second locking device 300. The second locking device 300 is constructed identically to the first locking device 200. The first locking device 200 and the second locking device 300 are arranged on mutually opposing sides of the electrical plug connector 100.

The second locking device 300 comprises a third locking hook 320 and a fourth locking hook 325. The third locking hook 320 is connected to the first housing part 110 by means of a third pin 321. The fourth locking hook 325 is connected to the first housing part 110 by means of a fourth pin 326. The third locking hook 320 and the fourth locking hook 325 are connected to each other via a second clip 310. The third locking hook 320 and the fourth locking hook 325 can be pivoted jointly about a second axis of rotation 360 oriented parallel to the first axis of rotation 260. A third locking element 330 is connected to the third locking hook 320 by means of a third bolt 331. A fourth locking element 335 is connected to the fourth locking hook 325 by means of a fourth bolt 336.

The second housing part 120 has a third journal 340 and a fourth journal 345. The second clip 310 has a second operating lip 350 which facilitates pivoting of the second locking device 300. The pivoting of the second locking device 300 allows the third locking element 330 to be passed around the third journal 340 and the fourth locking element 335 to be passed around the fourth journal 345.

The first locking device 200 and the second locking device 300 serve to connect the second housing part 120 to the first housing part 110 of the electrical plug connector 100 or to lock the second housing part 120 and the first housing part 110 together and to rerelease the lock. FIG. 1 shows the first locking device 200 in the opened state and the second locking device 300 in the locked state.

In a simplified embodiment of the electrical plug connector 100, the second locking device 300 may be dispensed with. In a further simplified embodiment of the electrical plug connector 100, the second locking hook 225 and the first clip 210 of the first locking device 200 may also be dispensed with. The first locking device 200 then comprises just the first locking hook 220 with the first locking element 230.

Figure 4:
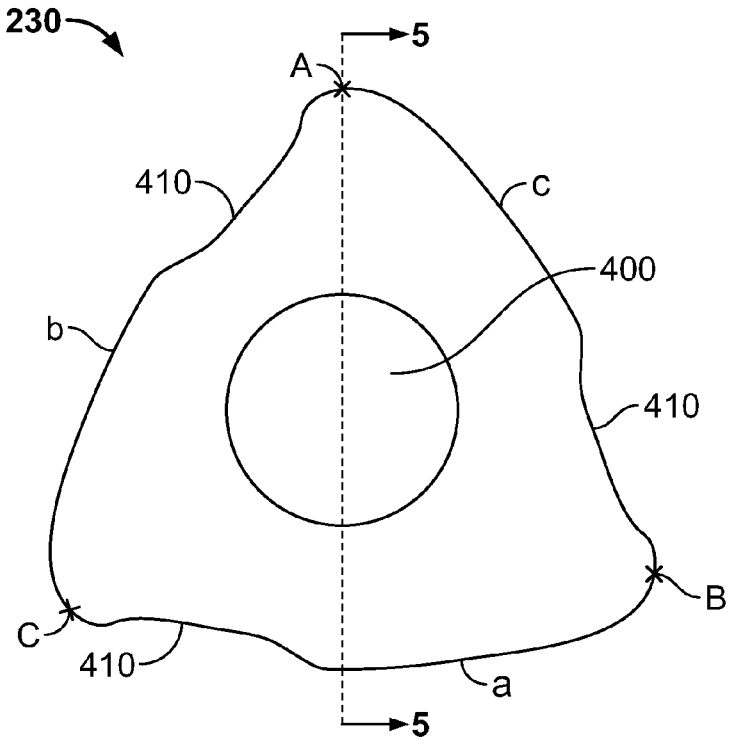
FIG. 4 is a plan view onto a first locking element according to a first embodiment.

FIG. 4 is a plan view onto the first locking element 230 according to a first embodiment. The first locking element 230 has a roughly triangular basic shape with corners A, B, C. However, in a departure from a pure triangular shape of the first locking element 230, the corners A, B, C of the first locking element 230 are rounded off. The first locking element 230 also comprises three outer edges a, b, c. The edge a opposes the corner A and connects the corners B and C. The edge b opposes the corner B and connects the corners A and C. The edge c opposes the corner C and connects the corners A and B.

Each of the edges a, b, c is arranged in a concave manner. The edge a accordingly does not connect the corners B and C on a straight line, but arches in the course between the corners B and C further away from the corner A. The edge a can for example follow the contour of an arc of a circle, the centre point of which lies on the corner A. The arc of a circle sweeps in this case an angle of 60°. However, the edge a can also display a larger or a smaller concavity or curvature. The edges b and c preferably display the same curvature as the edge a. Each of the edges a, b, c can for example have a length of between 5 mm and 25 mm. Particularly preferably, each of the edges a, b, c has a length of between 10 mm and 20 mm. However, the edges a, b, c may also be longer or shorter.

Furthermore, each of the edges a, b, c has a recess 410. A portion of the respective concave edge a, b, c is removed in the region of the recesses 410, so that the edges a, b, c each have a convex contour in the region of the recesses 410. Each of the recesses 410 can for example have a depth of approximately 1 mm. Each of the recesses 410 comprises roughly half the length of the respective edge a, b, c. In the embodiment illustrated in FIG. 4 of the first locking element 230, the recesses 410 are arranged asymmetrically closer to an in each case second end, in the clockwise direction, of the edges a, b, c. The recess 410 in the edge a is therefore located closer to the corner C than to the corner B. In a simplified design of the first locking element 230, the recesses 410 may be dispensed with.

In addition, the first locking element 230 has a central borehole 400. The central borehole 400 can for example have a diameter of 5.5 mm. The borehole 400 is provided to receive the first bolt 231 via which the first locking element 230 is connected to the first locking hook 220.

Overall, the first locking element 230 is arranged rotationally symmetrically with respect to rotation through an angle of 120°. The third locking element 330 of the electrical plug connector 100 shown in FIGS. 1 to 3 is arranged identically to the first locking element 230. The second locking element 235 and the fourth locking element 335 are arranged mirror-symmetrically to the first locking element 230 of FIG. 4.

The concave contour of the edges a, b, c of the first locking element 230 supports the locking function of the first locking hook 220. If the first locking hook 220 is pivoted about the first axis of rotation 260, so that the first locking element 230 is passed around the first journal 240, then one of the edges a, b, c rolls on a portion of the lateral surface of the first journal 240. This prevents damage to the first journal 240.

The triangular basic shape of the first locking element 230 ensures that passing of the first locking element 230 around the first journal 240 can be carried out in all the positions of rotation of the first locking element 230 about the axis of rotation formed by the first bolt 231.

As soon as the first locking element 230 is passed around the first journal 240 by pivoting the first locking hook 220, the first journal 240 comes to lie in one of the recesses 410 of the first locking element 230. One of the recesses 410 of the first locking element 230 therefore engages on the first journal 240. This impedes or completely prevents accidental opening of the first locking hook 220. If the recesses 410 are dispensed with, then one of the edges a, b, c of the first locking element 230 comes to lie against the first journal 240.

The distances between the first pin 221 and the first bolt 231 of the first locking hook 220 and between the first pin 221 and the first journal 240 are of dimensions such that the first locking element 230 rests tight against the first journal 240 when the first locking hook 220 is locked. In order to open the first locking hook 220, the first locking element 230 is passed around the first journal 240 in the opposite direction to the closing movement by pivoting the first locking hook 220 about the first axis of rotation 260. This advantageously necessitates the application of a certain force, thereby preventing accidental opening. FIG. 1 shows the first locking device 200 in the opened state and the second locking device 300 in the closed state.

Figure 5:
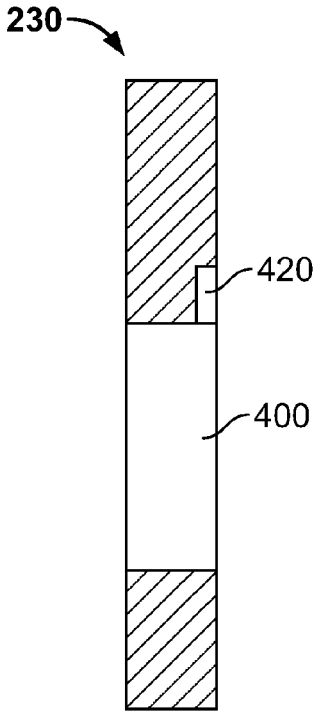
FIG. 5 is a section through the first locking element.

FIG. 5 is a section through the first locking element 230. The first locking element 230 can for example have a thickness of 2 mm. It may be seen that a surface of the first locking element 230 has a notch 420 extending from the borehole 400 of the first locking element 230 in the direction toward one of the corners A, B, C of the first locking element 230. The notch 420 serves to mount the first locking element 230 in a simplified manner. In particular, the notch 420 is a means for simplified positioning of the elements to be connected. The bolt 331 accordingly has an appropriate means (not shown here in greater detail) which reaches into the notch 420. The notch 420 can for example have a depth of 0.5 mm.

The first locking element 230 can for example be made of steel. The surfaces of the first locking element 230 can be zinc-plated or chromium-plated in order to prevent corrosion of the first locking element.

Figure 6:
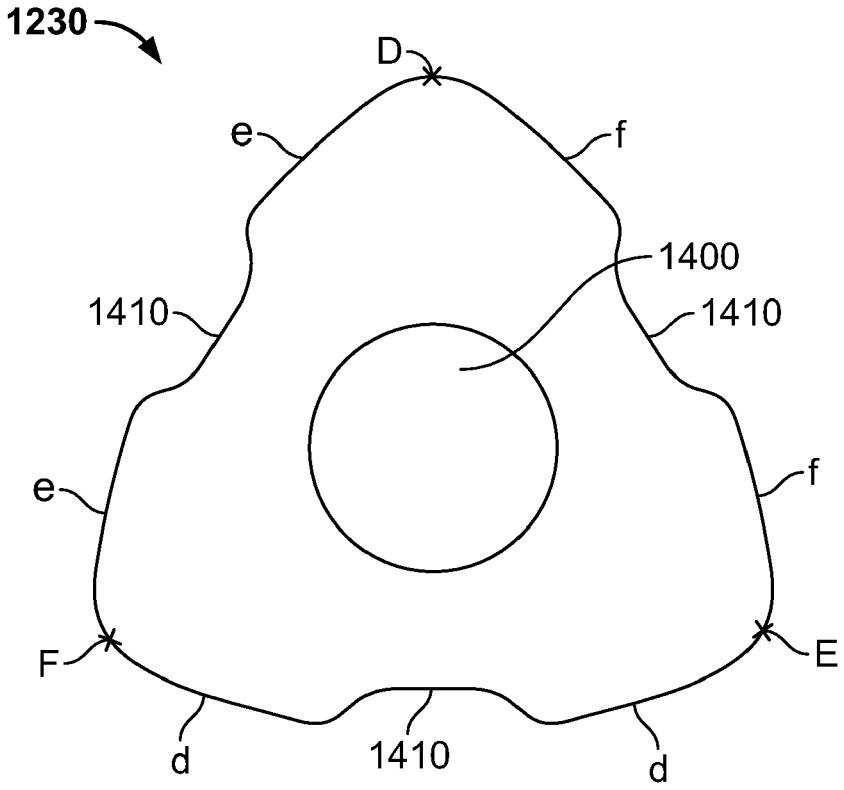
FIG. 6 is a plan view onto a locking element according to a second embodiment.

FIG. 6 is a plan view onto a locking element 1230 according to a second embodiment. The locking element 1230 can replace the first locking element 230, the second locking element 235, the third locking element 330 and the fourth locking element 335 of the electrical plug connector 100 of FIGS. 1 to 3.

The locking element 1230 also has a roughly triangular basic shape with corners D, E, F. However, in contrast to a triangular shape, the corners D, E, F are rounded off. Furthermore, the locking element 1230 has three edges d, e, f. The edge d opposes the corner D and extends between the corners E and F. The edge e opposes the corner E and extends between the corners D and F. The edge f opposes the corner F and extends between the corners D and E. Each of the edges d, e, f has a concave contour. For example, the contour of the edge d can follow an arc of a circle portion of 60°, the centre point of which lies at the corner D. However, the edge d can also display a larger or a smaller curvature or concavity. The edges e and f are preferably shaped accordingly.

Furthermore, each of the edges d, e, f of the locking element 1230 has a recess 1410. Each of the recesses 1410 is arranged symmetrically and arranged centrally between the respective end points of the edges d, e, f. The recess 1410 in the edge d is therefore arranged symmetrically between the corners E and F. In the region of the recesses 1410, the concave contour of the respective edge d, e, f is interrupted and replaced by a convex portion. Each of the recesses 1410 can for example have a depth of approximately 1 mm. Each of the recesses 1410 takes up about ⅓ of the length of the respective edge d, e, f. Each of the edges d, e, f can for example have a length of 15 mm. However, the edges d, e, f may also be longer or shorter than 15 mm. In a simplified design of the locking element 1230, the recesses 1410 may be dispensed with.

In addition, the locking element 1230 has a central borehole 1400 which serves to receive a pin by means of which the locking element 1230 can be attached to a locking hook. The borehole 1400 can for example have a diameter of 5.5 mm.

Overall, the locking element 1230 is arranged rotationally symmetrically with respect to rotation through an angle of 120°. In addition, the locking element 1230 is arranged mirror-symmetrically with respect to mirroring at an axis extending from the corner D to the centre point of the edge d. Thus, the locking element 1230 can be used both on the first locking hook 220 and on the second locking hook 225 of the electrical plug connector 100.

The convex contours of the edge d, e, f also support rolling of the locking element 1230 on the journals 240, 245, 340, 345 of the second housing part 120. The recesses 1410 secure the locking element 1230 on the respective journal 240, 245, 340, 345 when the electrical plug connector 100 is locked.

Figure 7:
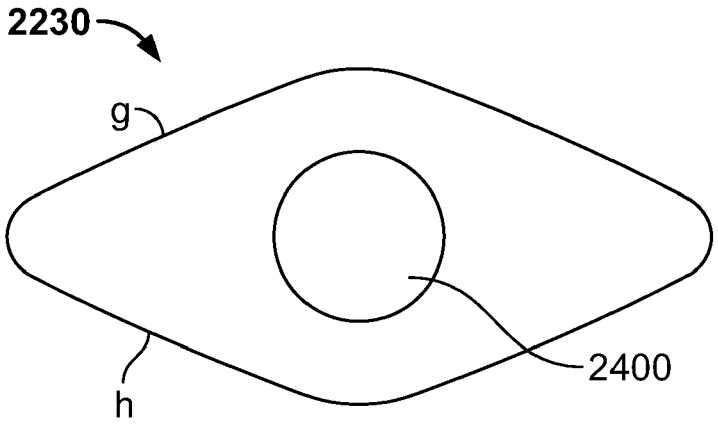
FIG. 7 is a plan view onto a locking element according to a third embodiment.

FIG. 7 is a plan view onto a locking element 2230 according to a third embodiment. The locking element 2230 can replace the first locking element 230, the second locking element 235, the third locking element 330 and the fourth locking element 335 of the electrical plug connector 100 of FIGS. 1 to 3.

The locking element 2230 has a roughly elliptical basic shape with two concave edges g, h arranged at an angle to each other. The locking element 2230 is arranged rotationally symmetrically with respect to rotation through an angle of 180°. In addition, the locking element 2230 is arranged mirror-symmetrically with respect to mirroring at an axis extending from the centre point of the edge g to the centre point of the edge h. This allows the locking element 2230 to be used both on the first locking hook 220 and on the second locking hook 225 of the electrical plug connector 100. However, in alternative embodiments, the locking element 2230 can also display no rotational symmetry and/or no mirror symmetry.

The edges g, h of the locking element 2230 do not have any recesses. When the locking hook carrying the locking element 2230 is locked, one of the edges g, h of the locking element 2230 comes to lie against the respective journal 240, 245, 340, 345. However, in an alternative embodiment, the edges g, h can also have convex recesses. In this embodiment, the respective journal 240, 245, 340, 345 comes to lie in one of the recesses when locked.

In addition, the locking element 2230 has a central borehole 2400 which serves to receive a pin by means of which the locking element 2230 can be attached to a locking hook. The borehole 2400 can for example have a diameter of 5.5 mm.

The invention claimed is:

1. Electrical plug connector with a first housing part and a second housing part, the second housing part having a first journal, the first housing part having a first locking hook, a first end of the first locking hook being rotatably connected to the first housing part, a second end of the first locking hook having a rotatably arranged first locking element, wherein the first locking element can be passed on a path partially around the first journal by pivoting the first locking hook, wherein the first locking element has a contour with at least two concave outer edges arranged at an angle to one another.

2. Electrical plug connector according to claim 1, wherein the first locking element is arranged symmetrically with respect to rotation through a defined angle.

3. Electrical plug connector according to claim 2, wherein the first locking element has a triangular contour with rounded-off corners and concave outer edges.

4. Electrical plug connector according to claim 1, wherein the concave outer edge has a recess.

5. Electrical plug connector according to claim 4, wherein each concave outer edge has a symmetrically arranged recess taking up roughly one third of the length of the outer edge.

6. Electrical plug connector according to claim 4, wherein each concave outer edge has an asymmetrically arranged recess taking up roughly half the length of the outer edge.

7. Electrical plug connector according to claim 1, wherein the first locking element has a central borehole, the first locking element being connected to the second end of the first locking hook via a bolt running through the central borehole.

8. Electrical plug connector according to claim 7, wherein a surface of the first locking element has a notch extending from the central borehole to one of the corners of the locking element.

9. Electrical plug connector according to claim 1, wherein each of the concave outer edges of the first locking element has roughly the contour of an arc of a circle having a radius (r) and an angle of 60°, the radius (r) having a size of between 5 mm and 25 mm, preferably between 10 mm and 20 mm.

10. Electrical plug connector according to claim 1, wherein the first locking element has a thickness of between 1 mm and 3 mm.

11. Electrical plug connector according to claim 1, wherein the first locking element is made of steel.

12. Electrical plug connector according to claim 1, wherein the surface of the first locking element is zinc-plated or chromium-plated.

13. Electrical plug connector according to claim 1, wherein the plug connector has a second locking hook with a second locking element, the first locking hook and the second locking hook being arranged on opposing outer faces of the first housing part and being pivotable about a common first axis of rotation, the second housing part having a second journal, wherein the second locking element can be passed on a path partially around the second journal by pivoting the second locking hook, the first and the second locking hook being connected to each other via a clip and forming a first locking device.

14. Electrical plug connector according to claim 13, wherein the plug connector has a second locking device which is pivotable about a second axis of rotation, the first axis of rotation and the second axis of rotation being oriented parallel to each other.

* * * * *